United States Patent [19]

Yurramendi Eguizabal

[11] 4,075,463

[45] Feb. 21, 1978

[54] DEVICE FOR AUTOMATICALLY SUPPLYING DRINKS AND FOODSTUFFS

[76] Inventor: José Miguel Yurramendi Eguizabal, Avenida del Generalisimio, 32, San Sebastian, Spain

[21] Appl. No.: 773,405

[22] Filed: Mar. 1, 1977

Related U.S. Application Data

[63] Continuation-in-part of Ser. No. 664,036, March 4, 1976, abandoned, which is a continuation of Ser. No. 439,864, Feb. 6, 1974, abandoned.

[51] Int. Cl.[2] ..... G06M 3/08; G07F 11/00

[52] U.S. Cl. ..... 235/92 AC; 221/7; 235/92 R; 312/236

[58] Field of Search ..... 235/92 AC, 92 FL, 92 CP, 235/92 PK, 92 PE, 92 FP, 94, 98 R; 312/117, 223, 236, 245; 221/7

[56] References Cited

U.S. PATENT DOCUMENTS

| | | | |
|---|---|---|---|
| 1,435,441 | 11/1922 | Zsoldos | 312/223 X |
| 1,638,813 | 8/1927 | Cochran | 312/117 |
| 2,300,345 | 10/1942 | Clerc | 312/223 X |
| 2,701,746 | 2/1955 | Piggott | 312/223 |
| 3,084,285 | 4/1963 | Bell et al. | 235/92 AC |
| 3,170,541 | 2/1965 | Werner | 312/236 X |
| 3,310,198 | 3/1967 | Regan et al. | 221/7 |
| 3,666,928 | 5/1972 | Burke et al. | 235/92 FL |
| 3,749,279 | 7/1973 | Ungerman | 221/7 |
| 3,884,386 | 5/1975 | Urcola | 221/7 |

*Primary Examiner*—Joseph M. Thesz
*Attorney, Agent, or Firm*—Wenderoth, Lind & Ponack

[57] ABSTRACT

An automatic control and supply system for foodstuffs, drinks and other products includes a registering system which is arranged in a cabinet divided into chilled, non-chilled and complementary electric and electronic unit containing zones. This cabinet has a lock. The chilled zone has a single or plural rows or receptacles with a variable number of receptacles in each row. A non-chilled zone has a single or plural rows or receptacles with a variable number of receptacles in each row. The receptacles are provided with extraction detector elements operable to detect and accumulate a record of the extraction of the products contained therein.

6 Claims, 43 Drawing Figures

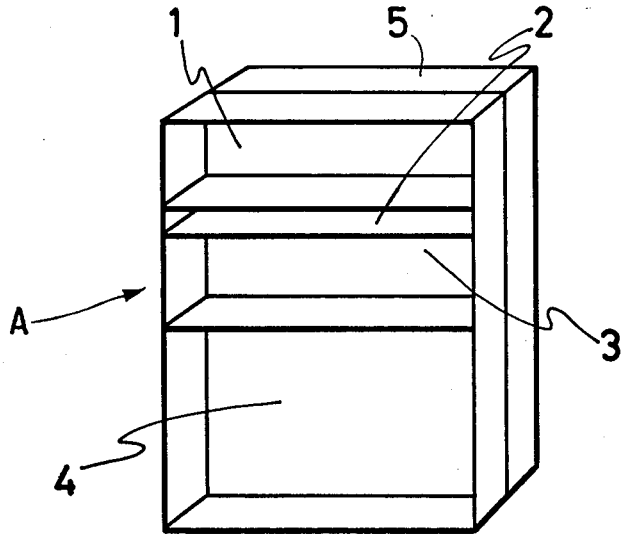
FIG-1
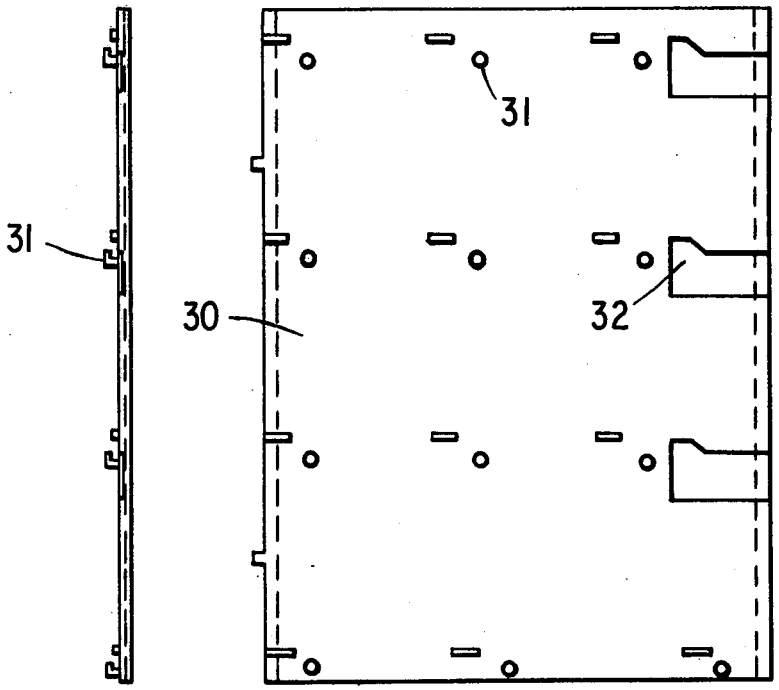
FIG. 4a
FIG-4b
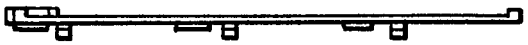
FIG. 4c

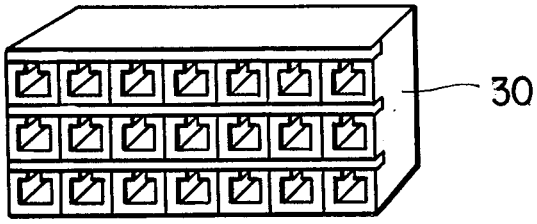
FIG-2
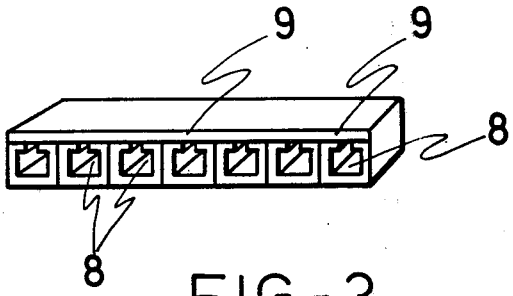
FIG-3
FIG. 5a
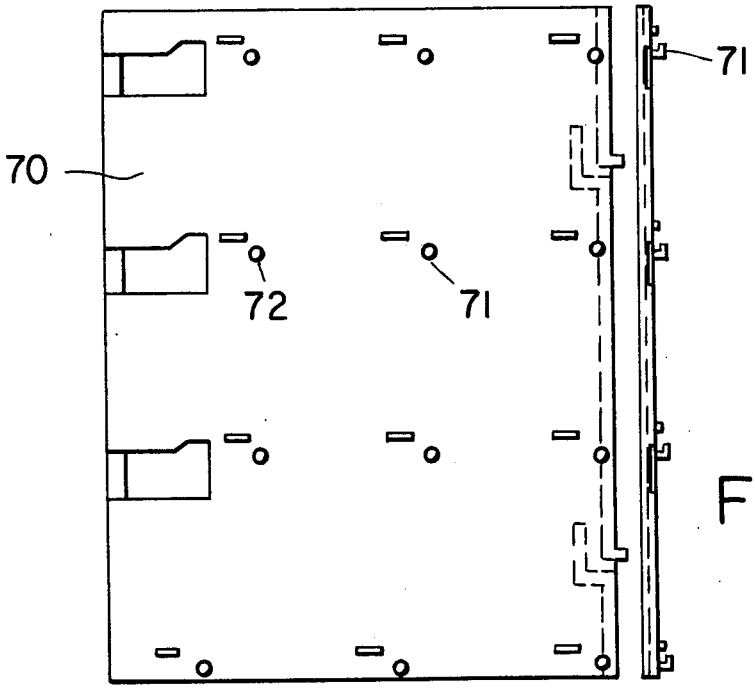
FIG-5b
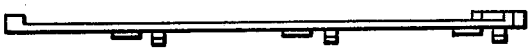
FIG. 5c

FIG. 6c
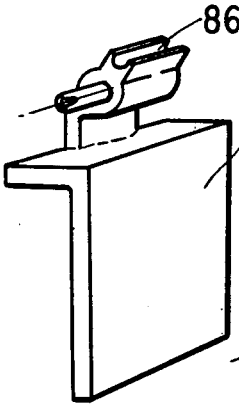
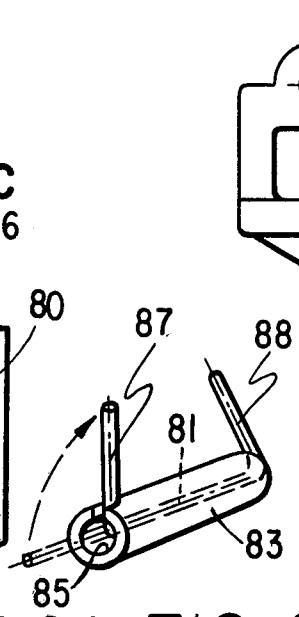
FIG. 6d
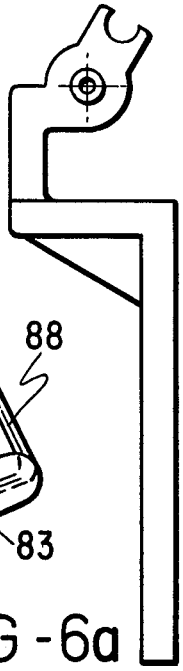
FIG-6a
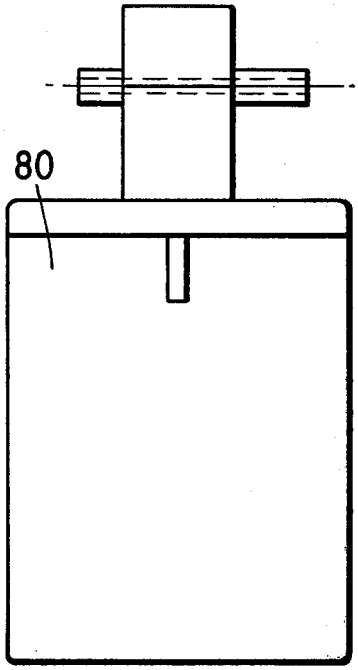
FIG. 6b
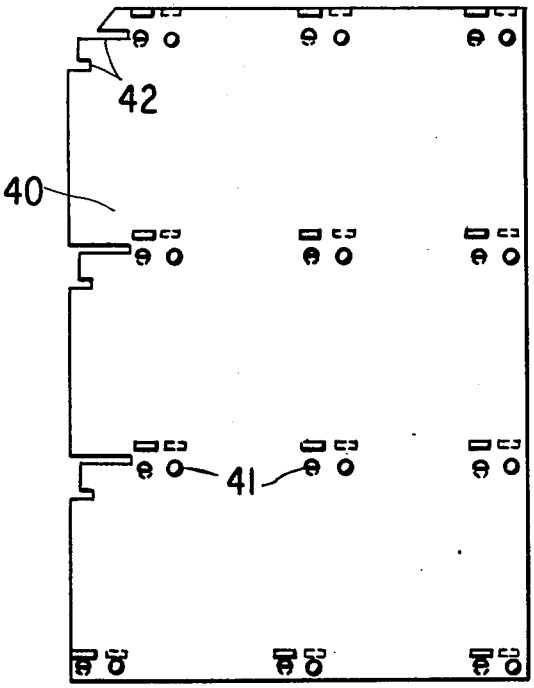
FIG-7a
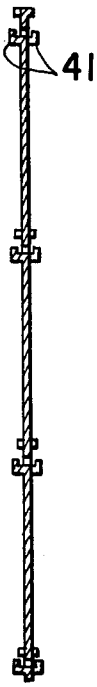
FIG. 7b
FIG. 9a
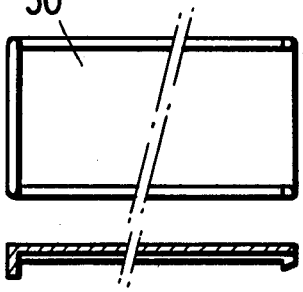
FIG-9b FIG. 8a
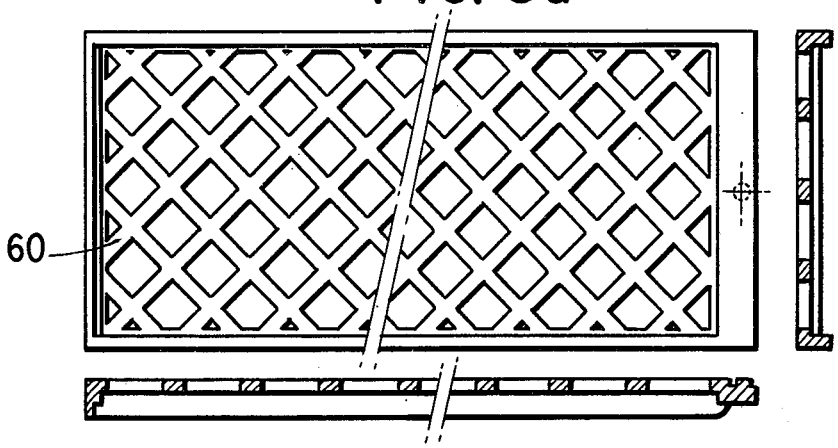
FIG. 8c
FIG-8b
FIG. 10a
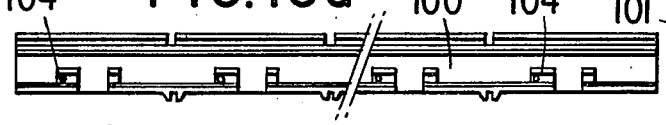
FIG. 10b
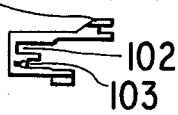
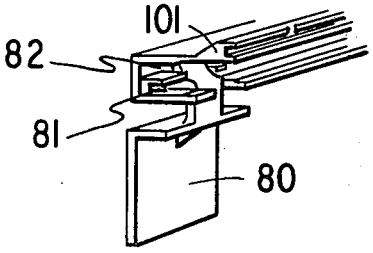
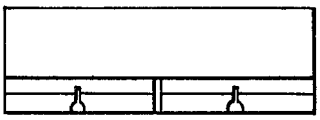
FIG-10c
FIG. 10d
FIG. 12b
FIG. 11a
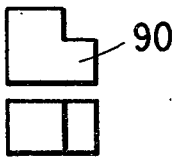
FIG-11b
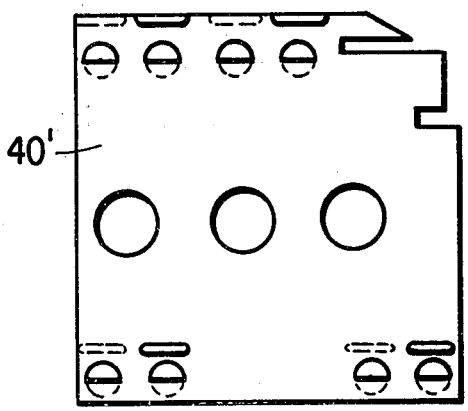
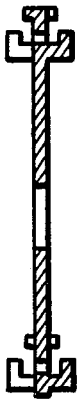
FIG-12a FIG. 13a
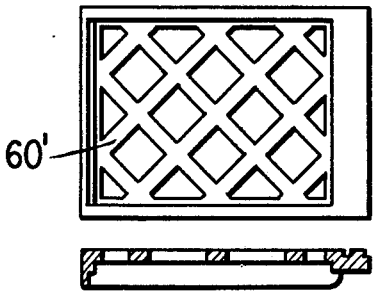
FIG. 13c
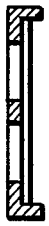
FIG-13b
FIG. 14a
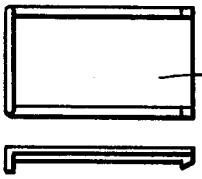
FIG-14b
FIG. 15a
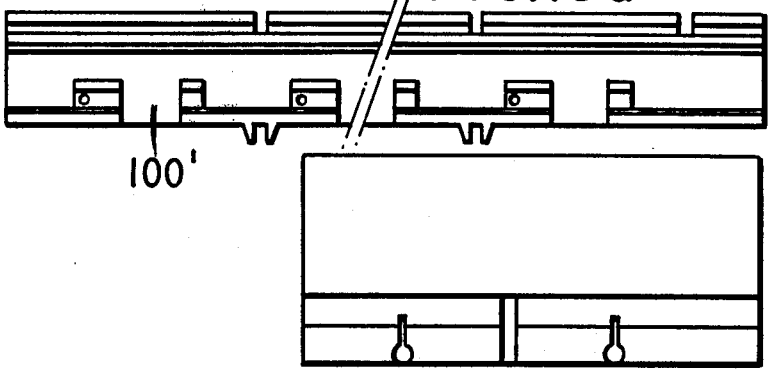
FIG. 15b
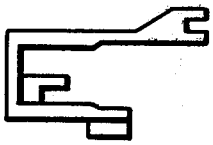
FIG-15c
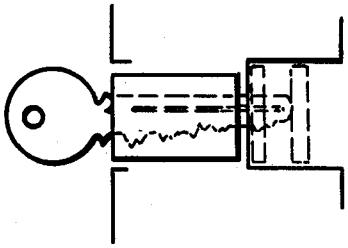
FIG-17

DEVICE FOR AUTOMATICALLY SUPPLYING DRINKS AND FOODSTUFFS

This is a continuation-in-part of application Ser. No. 664,036, filed Mar. 4, 1976, which is a continuation of application Ser. No. 439,864, filed Feb. 6, 1974, both now abandoned.

BACKGROUND OF THE INVENTION

This invention relates to a system designed for supplying foodstuffs, drinks and other products to a consumer who, in order to acquire a desired product, does not need to use money pieces or coins, nor does he have to register the consumptions made, but need only withdraw the desired products. The system includes devices which detect the extraction and register the amount of the consumed product, adding it to subsequent consumptions made by the same client.

Devices for supplying drinks, other devices for supplying foodstuffs and still other devices for supplying different products exist in the market. From a functional point of view, all these devices can be divided into two large groups, i.e. those which require the insertion of money pieces or coins in order to obtain the desired product, and those which do not require the introduction of money pieces or coins.

The first type of mentioned devices are, with regard to their end purpose and their construction, essentially different from the units of the present invention. The second type of mentioned devices have an end purpose which is similar to that of the units of the present invention. Generally, in order to take the desired product, the consumer has to press a push-button, and on doing so the product is released. The products are not generally visible to the consumer, and he therefore runs the risk of choosing a product which has become exhausted but which, nevertheless, is registered. All these devices ae constructed of electro-mechanical elements and are thus highly complex and have functional problems insofar as obstructions and breakdowns are concerned. When these elements are designed to supply drinks, they must function in a humid atmosphere, and thus the metallic materials with which they are constructed give rise to problems due to oxidation. When these units are designed to supply cooled drinks, the problems become worse due to the fact that the presence of cold and moisture causes breakdowns due to condensation in the electromechanical elements.

When these units include a device which registers the consumptions made, they have a very serious drawback in that each product can have only a limited number of values, generally between one and ten. Since these numerals can hardly ever correspond to the price of the products, the unit of the amount registered must be given a value, and the price to be paid by the consumer will be the product of the registered amount by such value. This has two drawbacks. Firstly, the registration does not correspond to the amount consumed, but it is only proportional thereto. Secondly, the prices of the various products are difficult to arrange in proper order, since if a low value is given to the proportionality factor the possible prices are very small and do not cover more than a small range, and on the other hand if a high value is given thereto the differences between the various products are excessive.

Another serious drawback of the previously described units is that due to their nature and construction they are rather bulky for a given number of bottles, thus resulting in two additional problems, i.e. the space taken up by the unit is not in proportion to its effective volume, and further the capacity of a cooling system, when employed, is too great for the actual cooling needs.

SUMMARY OF THE INVENTION

The object of the present invention is to provide a system which overcomes all these previously mentioned disadvantages. The functions of the system of the present invention is the same as that of the described prior art units, but they radically differ with regard to construction and operation from such known units. The only common feature is the cold-producing or refrigeration system, when included, which can be of the absorption or compression type and which novelly can apply the Peltier effect.

The system of the present invention can be used to supply cooled drinks, cold foods, non-chilled drinks, non-chilled foodstuffs and other products such as toilet accessories, soaps, tooth brushes, lotions, colognes, toothpastes, etc. A unit can be constructed to supply all these mentioned products or only one of some of them.

The unit or system of the invention may be arranged in places to which access is restricted to a single person or to a group of persons who will jointly or individually be responsible for the consumptions made and registered. The system of the invention is ideally suitable for hotel rooms, residences, clinics and similar centers. If the unit is positioned in a hotel room, the person or persons in possession of the key of the room will be responsible for the consumptions effected since he will be the only person who has access to the unit. When this person vacates the room he will be responsible for the consumptions registered, and if another person then occupies the room he would then have the exclusive access to the room and thus would be thereafter responsible for the consumptions effected.

Therefore, the devices of the invention are designed to be positioned in hotel rooms, clinics, inns, hotels and other similar centers and are designed to enable the hotel manager to offer to his clients, without the intervention of the personnel of the hotel, a number of products, drinks, foodstuffs or other products, which satisfy the possible desires at any hour of the day or night. The hotel manager has at all times a registering device which registers the overall consumptions made by the client without the need of verification or human intervention.

The most important advantages of the devcies of the present invention are:

For the hotel manager:

The number of sales increases due to the fact that the client has the products within his reach, in his own room, and only has to take them. The number of sales may also increase because the presence of the unit in the hotel room causes the client to consume items which he would probably not otherwise order.

The cost of room services decreases remarkably, since the hotel personnel do not have to deliver the products, and such personnel can even be dispensed with or they can carry out other functions.

Accounting is made with less expense, without errors and with greater speed, since the price is registered at the time the consumption is made.

Service is remarkably improved, since it is immediate when the consumer desires.

The system provides better service which allows the manager to be ahead of competition.

For the client:

His privacy is not disturbed by strangers who enter his room to attend him.

He has at his disposal, at any time of the day or night, an in his own room, drinks and foodstuffs which he can take without any effort when desired.

He does not need money pieces to effect the consumption, but only his key which he receives together with the room key.

No one else but him can take the products since he is in possession of the only key. The waiter has a master key, but when the unit is opened by the key of the waiter the products extracted are not registered. The client can, therefore, be completely sure that the amount debited to him corresponds to his consumption.

There are other numerous advantages for both parties which have been omitted so as not to make the description tedious.

The apparatus of the system may be of the three types.

The apparatus may have one compartment for chilled products and another compartment for non-chilled products, with a refrigeration unit to produce ice cubes.

The apparatus may have one compartment both for chilled products and also including a refrigeration unit to produce ice cubes.

The apparatus may have one compartment for non-chilled products which does not include a refrigeration unit.

The products are arranged within the apparatus so that they can be reached by the client very easily. They will be placed horizontally in an assembly of receptacles.

The assembly of receptacles forms a block constituted by various elements which are so assembled to each other that the number of receptacles can be varied at will.

Independently of the number of receptacles and their size, one product will be arranged in each receptacle, and only a door or swing bar, which can be large or small, will exist as a barrier between the product and the client.

The swing bars will preferably be of transparent material, and when the client desires to remove a product, he need only move the swing bar towards him and upwardly, thus freeing the mouth of the receptacle, so that he will be able to extract the product. It is also possible to grasp the product and to pull it, whereby the swing bar will be lifted. On the other hand, the swing bar is free and can in no case be blocked. A small spring makes it return to its initial position once the corresponding product has been withdrawn.

Each product will be assigned a value, which may be between one and 1,584, and which can be varied at the will of the owner of the apparatus by means of a computer incorporated in the unit. Besides these values, any other values obtained by multiplying them or dividing them by ten or by multiples of 10 are possible.

When the client extracts a product, the price thereof will be registered in a corresponding registering device. The subsequent consumptions will be added, and the final result for a given apparatus and client will be the sum of the prices of the various products consumed.

Registration will be carried out in a centralized site for all the units arranged in the same hotel, or in each one of the units, or in both places simultaneously.

The system also enables registeration of each one of the types of products consumed and contained in all the units in the same hotel, in order to control the stock, without having an effect on the price. In this case, and in the central registering point, a device capable of receiving and storing the consumptions made of each type of product will be arranged. This device will be connected to each and every one of the units constituting the installation.

The main components of the present invention include the following.

A cabinet having any desired shape and dimensions has a door with a lock, and will include, when the apparatus contains chilled products, a refrigeration unit. Naturally this refrigeration unit can be any conventional unit existing in the market, if so desired. Due to the modular nature of the receptacle arrangement of the invention, the cabinent can be adapted to any refrigerator, and therefore use can be made of refrigerators already existing in the hotel.

A refrigeration unit will be arranged inside the cabinet, only when the apparatus is designed to contain at least some chilled products.

An assembly of receptacles designed to contain chilled products, together with corresponding extraction detectors, will be placed in the cabinet.

An assembly of receptacles designed to contain non-chilled products, together with corresponding extraction detectors, and necessary isolation elements when the cabinet includes a refrigeration unit, will be arranged in the cabinet.

An electronic memorizing, registering, data processing and computing unit will, with the exception of the registering portion, be placed in the cabinet.

A lock is provided on the cabinet.

With these elements, the operation of the system will be as follows.

A client of the hotel simultaneously receives a key for a room and a key for the cabinet located therein. If the client desires to take any product from those placed at his disposal within the cabinet, he will open the door of the cabinet with his key, and thereby he will be able to take any of the products from the receptacles by just lifting the door or swing bar which protects the chosen product. Each of the receptacles will be marked with the name and type of the product which it contains as well as its price, which will be that which will be registered should the product be extracted by the client. Besides being marked with the type and price of the product, the swing bar is transparent which allows the consumer to see, before activating the swing bar, whether or not the receptacle really contains the product. If the client activates a swing bar which was previously emptied of its contents, the price will not be registered, since when the receptacle is empty even though the swing bar is activated a number of times, the price will not again be registered until the product has been replaced therein by operaton of a master key.

The consumer can take all the products simultaneously. However, this does not mean that extraction of any of the products will not be registered, since the electronic device retains memory of extraction up to the point where registration has been effected.

When the swing bar is activated, the corresponding detector is energized, thereby emitting a signal to the electronic unit. This signal passes through the memory to the computer and, in view of the value previously programmed by the hotel manager, the signal is emitted to the registering system which records the values in pesetas (or in any other monetary unit) programmed for the consumed product, adding the same to the price of the consumptions previously effected. This registering device will be placed in a centralized location for all the units, or in each unit, or in both sites simultaneously.

For the time that the client has access to the room, all annotations which appear on the registering system will be charged to him and the hotel manager will bill the same to him at the time he wishes.

Replacement of the consumed product will be effected by an employee of the hotel who has a master key which acts upon the lock of the cabinet and which, on being inserted therein, will effect the following functions. The master key opens the door of the apparatus, blocks the electronic system in such a way that even though any product is withdrawn the same will not be registered, thus avoiding an unfair charge to the client if, by error or any other reason, the employee activates a swing bar of a receptacle from which the product was not withdrawn. When the master key is once again removed, the mentioned apparatus is ready to register extractions from all and each one of the receptacles when activated.

If electric power fails during functioning of the apparatus, products can be extracted since the unit incorporates an emergency device which acts as follows.

It memorizes the products previously extracted.

It registers extraction of new products and memorizes the same.

If an electric power failure coincides with the process of registration this will be interrupted, but the interruption point will be memorized, and when electric power is restored the registration process will be renewed at such point and will ultimately be completed, furthermore registering the prices of the products withdrawn during interruption.

This feature will be explained by the following example. Assume that the client has extracted a product which costs 106 pesetas and which is being registered. At the time an electric power failure occurs only 47 pesetas have been registered. Assume furthermore that during the time the interruption lasts the client extracts a second product which costs 64 pesetas and a third product which costs 106 pesetas. While the electric power failure lasts the registering element will be out of use. When electric power is restored, the electronic unit will order the registering element to add to the figure already registered the remaining 59 pesetas of the first product, plus the 64 pesetas which is the price of the second product consumption, plus a further 106 pesetas for the third product consumption effected.

The cooling unit will function automatically and will automatically regulate the temperature of the cooling area by means of a thermostat. The modular feature of the present invention renders it easily coupled to any cooler or refrigerator system existing on the market.

Once the assembly of the invention has fully been understood, other details and characteristics thereof will become evident in the course of the description which will subsequently be made, wherein the special features of the invention, as well as those of the means used for its execution, will be explained. These features are given by way of example only, with reference to a preferred embodiment. However, the invention is not entirely limited to the details herein outlined, and this description should therefore be considered as illustrative and not limiting.

BRIEF DESCRIPTION OF THE DRAWINGS

The following description gives more detailed explanation of the invention. Such description refers to the drawings attached hereto, wherein preferred details of the invention are schematically represented by way of example only and wherein:

FIG. 1 is a perspective view of the device of the invention wherein the cabinet thereof is illustrated as divided into specific areas which form the internal arrangement of the apparatus. It should be emphasized that the main feature is the existence of the five zones, but not their relative distribution or positions within the cabinet;

FIG. 2 is a perspective view of an assembly of receptacles, destined to contain cooled or chilled products, with the corresponding detection devices to be placed in zone 4 of FIG. 1;

FIG. 3 is a perspective view of an assembly of receptacles, destined to contain the non-cooled or non-chilled products, with the corresponding detection devices to be placed in zone 1 of FIG. 1;

FIGS. 4*a*, 4*b* and 4*c* are respectively side, front and plan views of the right side element for the modular assembly of receptacles of FIG. 2;

FIGS. 5*a*, 5*b* and 5*c* are respectively side, front and plan views of the left side element for the modular assembly of receptacles of FIG. 2;

FIGS. 6*a*, 6*b*, 6*c* and 6*d* are respectively side, front and perspective views of one of the doors or swing bars shown in FIGS. 2 and 3, and a perspective view of the supporting axis and spring thereof;

FIGS. 7*a* and 7*b* are respectively side and section views of the separating partition element for the modular assembly of receptacles of FIG. 2;

FIGS. 8*a*, 8*b* and 8*c* are respectively plan, front section and lateral section views of the intermediate shelf for the modular assembly of receptacles of FIG. 2;

FIGS. 9*a* and 9*b* are respectively plan and section views of the base element for the modular assembly of receptacles of FIG. 2;

FIGS. 10*a*, 10*b*, 10*c* and 10*d* are respectively rear, side and plan views of the dividing strip for the modular assembly of receptacles of FIG. 2, and a perspective view of the assembly of the swing bar to the strip;

FIGS. 11*a* and 11*b* are respectively side and top views of blocks used to fasten the swing bar to the dividing strip;

FIGS. 12*a* and 12*b* are respectively side and section views of the separating partition element for the modular assembly of receptacles of FIG. 3;

FIGS. 13*a*, 13*b* and 13*c* are respectively plan, front section and lateral section views of the intermediate shelf for the modular assembly of receptacles of FIG. 3;

FIGS. 14*a* and 14*b* are respectively plan and front views of the base element for the modular assembly of receptacles of FIG. 3;

FIGS. 15*a*, 15*b* and 15*c* are respectively rear, side and plan views of the dividing strip for the modular assembly of receptacles of FIG. 3;

FIG. 17 is a schematic illustration of the dual lock used in the present invention;

DETAILED DESCRIPTION OF THE INVENTION

Figure 16:
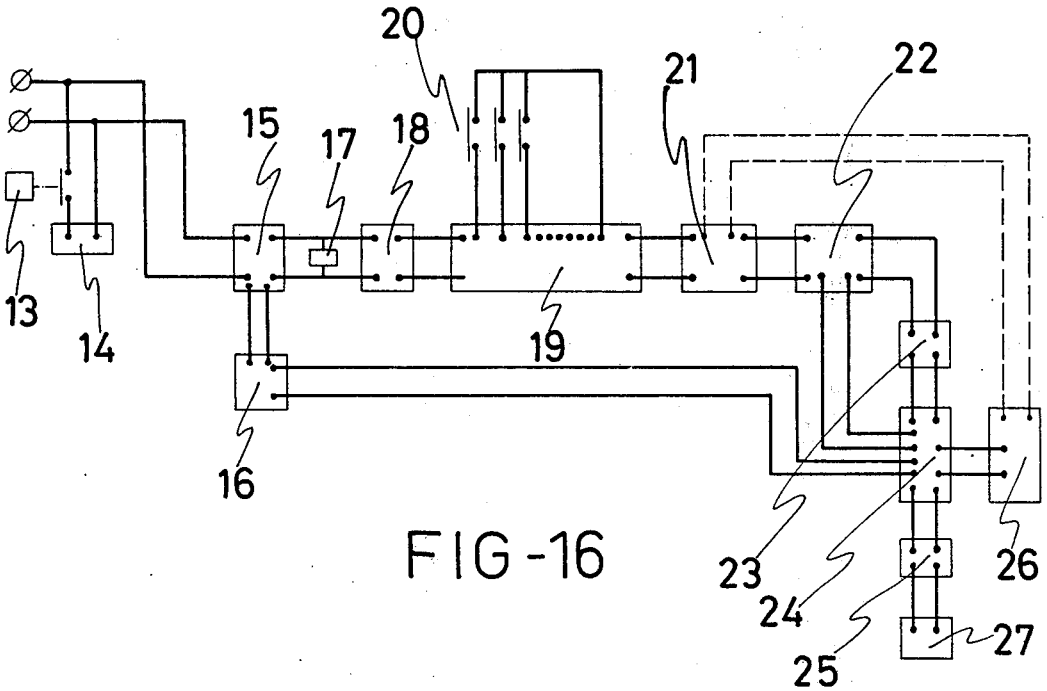
FIG. 16 is a schematic circuit diagram of the electric and/or electronic elements of the present invention.

With reference to FIG. 1, a cabinet A has therein a zone 1 destined to contain non-chilled products, a zone 2 destined to thermally insulate and separate the cooled zones and the non-cooled zones, a zone 3 destined to contain ice cubes and their container, as well as the interchanger of the cooling system, zone or area 3 being in its major part free to permit the placing of glasses or various objects therein, and a zone 4 destined to contain the receptacles corresponding to chilled products.

The size of these areas will depend on the number of chilled and non-chilled products contained therein. In some cases, some of these zones can be eliminated, if only chilled products or exclusively non-chilled products are contained therein.

Zone 5 is destined to contain the cooling system and the electronic system.

The assembly of receptacles is formed as follows.

The receptacle assembly shown in FIG. 2 is formed by positioning a right side element 30, represented in FIGS. 4*a*, 4*b* and 4*c*, opposite a larger separating partition element 40, as represented in FIGS. 7*a* and 7*b*. A base element 50, represented in FIGS. 9*a* and 9*b*, and as many intermediate shelves 60, represented in FIGS. 8*a*, 8*b* and 8*c*, as necessary to form the number of rows required, are inserted along slider elements 31 and 41 of elements 30 and 40, respectively. The height of right side element 30 and of the large separating partition element 40 will depend on the number of rows desired. An additional separating partition element 40 is then provided, and both partitions are joined by means of the corresponding intermediate shelves 60 and a base element 50. This arrangement is carried out as many times as necessary until completion of the desired number of columns of receptacles, less one. The left side element 70, shown in FIGS. 5*a*, 5*b* and 5*c*, is then positioned to face the leftmost large separating partition element 40, and these two elements are joined by means of additional intermediate shelves 60 and a base element 50. A plurality of swing bars 80, shown in FIGS. 6*a*, 6*b*, 6*c* and 6*d*, are each coupled to a block 90, shown in FIGS. 11*a* and 11*b*, positioned on the large dividing strip 100, as can be seen in FIGS. 10*a*, 10*b*, 10*c* and 10*d*. In order to effect this coupling, a spring 81 and a magnet 82 are arranged on the swing bar or door in a manner to be described below. On the dividing strip 100 there are as many swing bars 80 as receptacles per row, and the dividing strip 100 will thus have a length corresponding to the number of receptacles desired. The assembly formed by the dividing strip 100 and the swing bars 80, together with their accessories, are coupled to the previously formed assembly of receptacles by means of projections 101 on strips 100 and grooves 32, 42 and 72 formed in elements 30, 40 and 70, respectively, the assembly thus forming a solid element. There are as many dividing strips 100 as rows of receptacles desired. In this way, there is formed an assembly similar to that represented in FIG. 2 and which will have a number of columns of receptacles, preferably between three and seven, and likewise a number of rows of receptacles, preferably between one and three.

FIG. 10*b* is a transversal or end view of a large dividing strip 100, wherein there are shown two small grooves 102 and 103. The pourposes of these grooves is to position therein a printed circuit, which will extend along the entire length of the strip, and reed-switches which will be soldered and which, on being energized by the magnet situated on the respective swing bar, will detect the extraction of the respective product. There will be a reed-switch for each receptacle precisely facing each respective magnet.

The assembly of the printed circuit will be prior to the introduction of the strip into the assembly of receptacles. In order to effect such assembly, the printed circuit is introduced into the strip, and the strip is in turn introduced into the assembly of receptacles, the printed circuit thus being held by the groove 102 of the strip and by the large separating partition elements 40.

The resulting assembly has the general configuration shown in FIG. 2 and will be open at its posterior end.

The smaller receptacles are formed in the same manner as the larger ones, the only differences residing in the fact that the left and right side elements, previously described, are replaced by the small separating partition elements 40′ of FIGS. 12*a* and 12*b* and using the small intermediate shelves 60′ of FIGS. 13*a*, 13*b* and 13*c*, the small base element 50′ of FIGS. 14*a* and 14*b*, a smaller dividing strip 100′ of FIGS. 15*a*, 15*b* and 15*c*, a smaller swing bar similar to that of FIGS. 6*a*, 6*b*, 6*c* and 6*d*, and a smaller block similar to that of FIGS. 11*a* and 11*b*, for assembly.

As previously mentioned, the swing bar incorporates therein a spring 81 and a magnet 82. As shown in FIGS. 6*a*–6*d* and 10*a*–10*d*, the spring 81 is a steel wire which traverses an axis 83 of the swing bar at the center thereof, and which has opposite ends 87 and 88 one of which is introduced into hole 104 in the dividing strip. The axis 83 of the swing bar, besides the hole 85, also has a groove 84 which holds the steel wire spring 81, which has the shape of a U. The wire acts as a spring due to the fact that when the swing bar moves, the wire is subjected to a twist which it opposes. In FIG. 6*d* the bore 85 in the center of the axis 83 of the swing bar and the groove 84 can be seen. In FIG. 6*c* is shown the groove 86 provided in the swing bar for the purpose of inserting the permanent magnet, and in FIG. 6*d* are shown the dissimilar orientations of ends 87 and 88 of the spring 81.

When the swing bar is at rest, the magnet is separated from the corresponding reed-switch. When the swing bar is activated the magnet describes an arc which makes it pass near the reed-switch, and which thus causes the reed-switch to change its state.

The term "reed-switch" as used herein is intended to include any hermetic electric contact element. This element comprises two or more sheets, as required, which are metallic and are enclosed in a glass capsule wherein a vacuum has been formed and from which electric conductors project to the exterior. In some cases, the glass capsule is coated with plastic so as to give it a mechanical consistency. The metallic sheets are made of magnetic material and on passing a magnet adjacent thereto, or when a magnetic field is created by means of another medium such as a coil, they move, coming together if they were separated or separating if they were united. In other words, the reed-switch acts like an electric contact which opens and closes. The advantages of this detection system are very important in this invention, since the adverse atmosphere does not affect the condition or position of the contacts, and a desired change in position cannot be avoided due to the fact that there are no anti-magnetic field.

The reed-switches corresponding to all the receptacles situated in the same row are arranged as previously mentioned on a printed circuit plate which is positioned in the respective dividing strip. In this printed circuit, as many conductors as reed-switches less one, which will be joined to all the reed-switches, will be printed. These conductors are joined to the electronic unit itself in such a way that when a reed-switch is activated by means of the corresponding magnet, the common reed-switch will short-circuit, with the inlet point in the electronic unit of the reed-switch corresponding to the receptacle whose swing bar was activated.

FIG. 16 is a circuit diagram which only schematically illustrates the electronic and electric parts of the device.

The two parallel lines situated in the left-most part of FIG. 16 represent the source of power to the entire system.

A thermostat 13 will either make the refrigeration unit function or not in accordance with the desired temperature achieved in the cooled zones of the system. This thermostat will be of the "all-nothing" type if cooling is produced by a compressor system or by an absorption system or of the proportional type if cooling is produced by the Peltier effect.

Reference number 14 represents the refrigeration unit which can be of the compressor, absorption or Peltier type. It should be noted that in cases in which the system is adapted to existing cooling cabinets, only the compressor system should be used, since it is desirable that the system should be absolutely silent.

The refrigeration unit in most cases will be of the absorption of Peltier type. The absorption system will not be described due to the fact that it is very well known and also due to the fact that this system incorporates conventional presently existing elements.

The Peltier effect is the property of certain semiconducting elements, consisting in that, when an electric current is passed therethrough, cold on one of its surfaces and heat on another surface are produced.

This cold producing system has the important advantages of satisfactory yield, relatively low maintenance, complete silence, and small size. In the present invention, the ratio of the number of products to volume is very large, and the application of the Peltier effect is reasonably economical.

In the case in which the system does not offer chilled products, the previously mentioned elements, i.e. the thermostat and refrigeration unit, will naturally not be provided.

A rectifier 15 of the feed source to the electronic components of the device essentially comprises a transformer which adapts the network voltage to the necessary voltage values for the feed. This transformer will have many outlets which will feed as many rectifying groups as various values of contemplated continuous voltage. In FIG. 16, there are shown a general feed rectifier which, together with the transformer, is included in block 15, and rectifier 16 which supplies the necessary voltage and power to create the impulses which will be sent to the registering system 26. Rectification in any case will be effected by any one of the conventional processes, using silicon or selenium rectifiers. The distribution of the rectifying group can be as follows: bridge, half-wave, full wave with two rectifying diodes and a half intake in the transformer, etc.

An assembly of batteries 17 will supply necessary electric energy in case of a power failure. These batteries will be charged and will be kept charged by means of a feed rectifier of the electronic circuits. At the time of a power failure, the batteries will supply the stored energy or power to the various circuits, thus keeping the same in operation. The period of time in which these batteries will be able to supply energy, when a power failure occurs, will be variable and will exclusively depend upon the capacity of the batteries chosen. In presently existing apparatus, this period of time in 20 minutes for 36 receptacles and greater periods of time for a lesser number of receptacles. These batteries only feed a part of the electronic circuit and specifically do not feed the impulse generator. Therefore, at the time of an electric energy failure, no data are sent to the registering system, i.e. the system is interrupted but will be renewed when electric energy is restored.

Connected to the batteries is a stabilizer 18 which is designed to deliver stabilized continuous voltage to the electronic components. This is a conventional continuous stabilizer which can be any one of the existing such systems.

Reference 19 represents the memory assembly having memories connected to the product withdrawal detectors. The memory assembly has as many inlets as detectors, plus an inlet common to all detectors. Each memory is coupled to a detector, and when the same is activated, thus closing the contact with the common inlet, the memory is energized and remains energized up to the point when the registering system has received the information contained in such memory.

Reference 20 represents the assembly of reed-switches or detectors discussed above. Only three have been represented, however there will be as many detectors as receptacles.

Reference 21 represents an exploring circuit which has the function of systematically exploring the memories. When the circuit detects an energized memory, exploration is suspended, and the impulse generator 23, the impulse meter 24 and the computer 22 are put into operation.

A determined number of impulses corresponding to a determined number of pesetas (or of any other monetary unit or fraction), corresponds to each memory. When a memory is energized and when the exploring circuit detects such energization, the impulse generator 23 sends impulses to the registering system 26 through the meter 24. The meter allows passage of the impulses until precisely the determined number of selected impulses are reached by means of the computer for each given memory. When the number of required impulses is reached, a series of operations take place.

Sending of impulses to the registering system is blocked.

The memory corresponding to the activated receptacle is freed.

The computer 22 remembers that the memory has already been energized and counted and cannot therefore be recounted even though it is once again energized.

The exploring circuit continues exploring the successive memories.

When the exploring circuit finds a new energized memory, the above mentioned process is repeated.

Functioning of the exploring circuit is determined by the registering system 26 used. If a meter is used as the registering system, exploration will be carried out permanently. Should an ordinator in its generic sense be used as the registering system, the exploring circuit will only function when the ordinator analyzes the apparatus in question. It will be sufficient therefore if the ordinator sends a signal to the apparatus which, at a specific moment, it is going to study.

The computer 22 comprises a printed circuit having a double surface with horizontal bars on one surface and vertical bars on the other, which is conveniently connected to, among other elements, the memories 19 and meter 24. Programming is effected by adequately bridging the horizontal bars with the vertical ones, in such a way that the desired value is obtained for each receptacle. The value of a receptacle is obtained as a result of multiplying a multiplicand by a multiplier. Multiplicands in any apparatus can have the values: 1, 2, 4, 8 or 16. After having chosen any one of these multiplicands, all the receptacles will have the same value. The multiplier can be any number between 1 and 99. Each one of these receptacles can take any one of the multipliers and, naturally, all can take the same value. In this way the receptacles of any apparatus can be assigned any value between one and 1,584. Besides the multiplicand and the multiplier previously described, each apparatus includes the possibility of multiplying or dividing these numbers by 10 as well as by multiples of 10. This permits adaptation of the system to the monetary units of any country.

The impulse generator 23 can be of any conventional design, and its frequency can be variable, from certain low values, e.g. seven or eight cycles, for a system such as a registering system in which an electromagnetic meter is used, up to various kilocycles in the case in which an ordinator or a digital meter is used as a registering system. The range of the impulses is also variable in order to adapt the same to the requirements of the registering system.

The meter 24 is a digital meter which can be of any conventional design and which has a given pre-determination for the computer 22.

The memories 25 are a complement of the previously mentioned memories and store the information that a receptacle has been emptied and counted, thus avoiding the value of the receptacle which has already been counted being registered again, if for any reason whatsoever the corresponding swing bar is again activated.

The registering system 26 stores the information of the sum of the values of the activated receptacles. It receives the number of impulses which represents the number of monetary units which was programmed for each receptacle, coming from the rest of the elements of the electronic circuit. For example, if the content of a receptacle is programmed as having a value of 63 pesetas, the registering system will receive 63 impulses.

The following registering systems may be provided.

Registration by electromagnetic meter is characterized in that the frequency of the supplied impulses should be very low, at the most fifty impulses per second. This system will not be described since the same is already known on the market. The meters used can be any of the types existing on the market and, for the sake of information may include: non-setting to zero, manual setting to zero, electrical setting to zero, setting to zero with printing.

Registration can be by digital meter wherein the frequency of the impulses can be very high, even as high as megacycles. The meters used can be of any of the types existing on the market and as the same are commercial elements, they will not be described here.

In both cases, and for each apparatus, there should be provided at least one permanently connected meter which will receive impulses sent thereto. As it receives impulses, it will add the same to those previously received. Certain visible numbers will at all times indicate the number of impulses received. Billing to the client will be obtained by the number appearing at the moment of effecting such billing.

The meters will have a single meter for each unit situated in the site where the billings of the clients are effected. Such site will have all the meters corresponding to all the units. Alternatively, each dispensing apparatus may have a meter therein. Further alternatively, a meter for each apparatus may be situated in the centralized site and another in each apparatus itself.

When the meters are non-setting to zero, the client will be billed with the difference in readings between the moment at which he leaves the room and the moment at which he took charge of the same.

When the meters are electric or manual setting to zero, when the client settles his account, the meter will be set to zero and the billing will correspond to the total number reflected on the meter. There are various possible multiples which are also usable, but which will be omitted due to the fact that they are common in commercial meters.

In many cases wherein other parameters are to be controlled, besides consumption from the apparatus, the use of an ordinator broadly speaking as a registering system is of great interest. If a person or entity installing the system has an ordinator, its use as a registering system becomes essential due to economic reasons.

The unit of the present invention is compatible with any ordinator, even though in many cases the use of an interface (coupling unit) is essential between the ordinator and the unit of the invention.

Should an ordinator be used as a registering system, there will only be one ordinator for all the units, and in such a way that there will be as many memory arrangements as units connecting the same.

An important feature of the unit of the present invention, insofar as it can be used to be connected to an ordinator, is that since the unit has memories, the ordinator will be able to effect the pertinent reading at any moment, thus making permanent or cyclic readings unnecessary, whereby the ordinator can be used for a longer period of time.

The unit is compatible with any other ordinator, irrespective of its characteristics. Therefore, and as it deals with commercial elements, the description thereof will be omitted.

The blocking system 27 is closely linked to the closure operation. The products contained in the apparatus are continuously consumed and should therefore be replenished. The person in charge of replenishing the apparatus will have a master key, shown in FIG. 17, and on inserting the same in the lock, the blocking system will be put into operation, at which time all the electronic circuits will be blocked, and even though all the detectors of all the receptacles are activated the registering system will not receive any signal whatsoever. When the master key is withdrawn from the lock, all the memories will be erased, the device will again be ready for registering, any detector which is energized will start the process, and the cost corresponding to the receptacle will be registered.

All the previously mentioned elements, electronic circuits, assemblies of receptacles, etc., excluding the exceptions previously cited, will be arranged in the cabinet which may have any desired shape, dimensions and aspect. Likewise, the materials employed in its manufacture can be of any nature.

If the cabinet is to be used for chilled products, then at the time of manufacture, especially with regard to structure and insulation, the end purpose should naturally be taken into account, this being the only limitation of the system. In this case any of the presently existing coolers can be used.

The modular character of the assembly of receptacles and the small space occupied thereby, as well as by the electronic unit, makes the system compatible with any other cabinet.

In all cases the cabinet will have a lock.

With regard to the lock, the assembly of receptacles will be arranged in a cabinet protected by a door having such lock. This lock will be conventional, and each unit will have a different normal key. A conventional lock will be fitted with a microswitch, in such a way that on inserting the normal key the microswitch is not activated, while on inserting the master key the microswitch will be activated. Therefore, the normal key will only open the unit, while the master key, besides opening the unit, will also operate the blocking system due to the action of the microswitch.

As stated above, the actual circuitry of the elements schematically shown in FIG. 16 may be of conventional elements the design and arrangement of which would be understood by those skilled in the art. However, with reference to FIGS. 18–22, one possible embodiment of detailed circuitry equivalent to that of FIG. 16 will be described. It is to understood, however, that the elements shown schematically in FIG. 16 may be achieved by conventional circuit elements other than those specifically illustrated in FIGS. 18–22.

Figure 18:
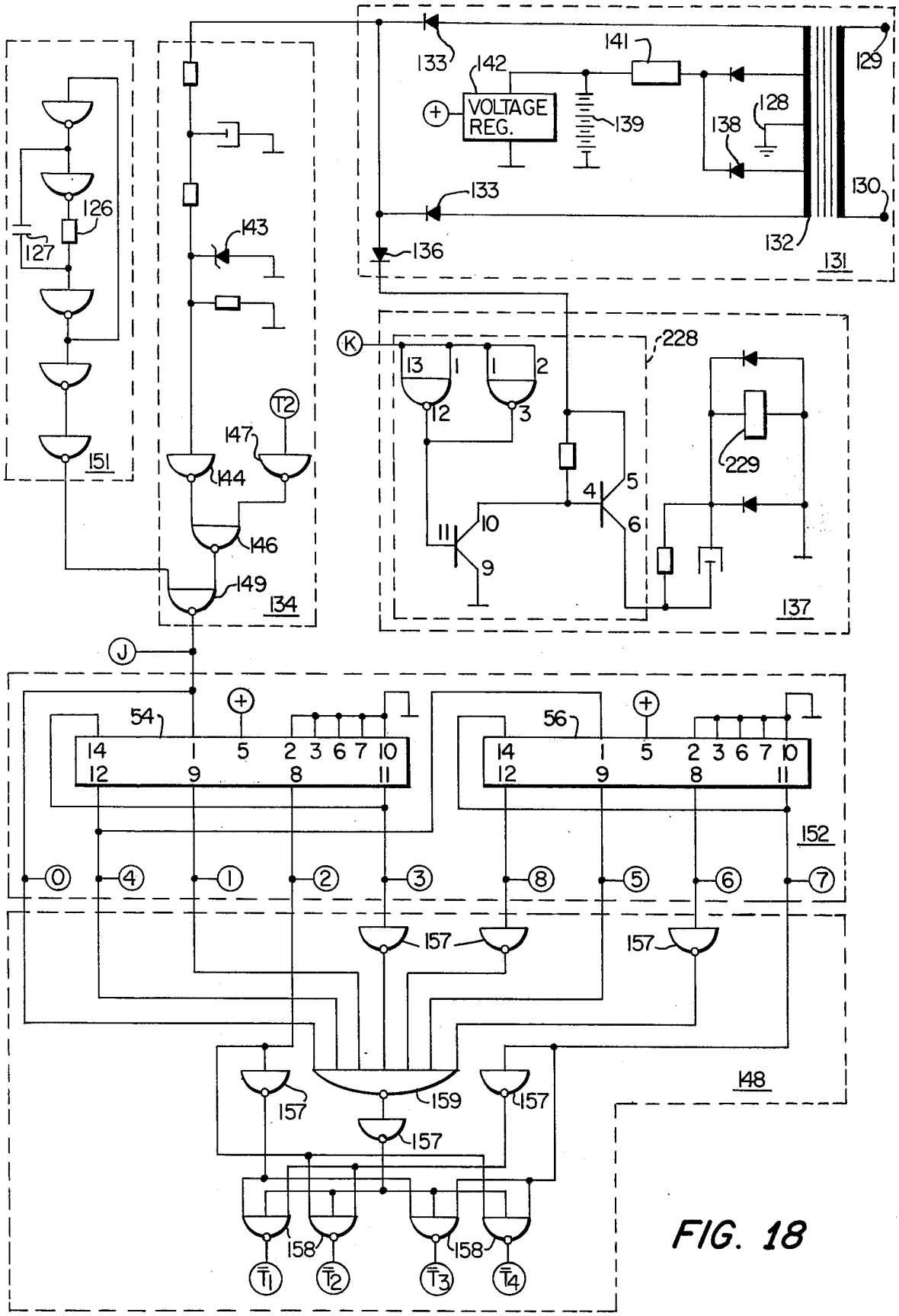
FIG. 18 is a schematic circuit diagram illustrating one embodiment of electronic circuits for accomplishing the functions of power supply, oscillation, power failure detection, frequency division, pulse timing, output amplification, and electromagnetic counting according to the invention.

In FIG. 18, a power supply circuit 131 includes a single phase transformer 132 having a primary winding connected to a source of A.C. power at terminals 129 and 130 and a tapped secondary winding having a grounded center tap 128. The secondary winding is connected to a first single phase, full wave rectifier bridge 133 having a d.c. output, e.g. a 24 volt d.c. output, which is supplied to a power failure detection circuit 134 and through a circuit isolating diode 136 to an output amplifier and electromagnetic counter circuit 137. A second single phase, full wave rectifier bridge 138 is connected to appropriate taps of the transformer secondary winding to produce a d.c. output, e.g. a 10 volt d.c. output, which is used to charge a battery 139, e.g. a 7.5 volt d.c. battery, through a current limiting resistor 141, and to supply power to a standard voltage regulating device 142, for example a 5 volt d.c. voltage regulating device such as a National type LM 309K integrated circuit voltage stabilizer. The output of the voltage regulating device 142 is used as the supply voltage for all of the logic circuit devices described herein.

In the power failure detection circuit 134, the 24 volt d.c. output from the first rectifier bridge 133 is filtered, reduced to an acceptable level by the Zener diode 143, and applied to the input of an inverter logic device 144 to produce a low, or "0", inverter output signal. The output of the inverter 144 is connected to one input of a two-input NAND gate 146. The other input of the NAND gate 146 is connected to the output of an inverter logic device 147, the input of which is connected to receive an inverted ("0") timing pulse $\overline{T2}$ from a pulse timing circuit 148, described hereinafter. The output of the NAND gate 146 is connected to a first input of another two-input NAND gate 149, the second input of which is connected to the output of an oscillator circuit 151. The output of NAND gate 149 is connected to a frequency divider circuit 152 and to a master signal generating circuit 153, described hereinbelow with reference to FIG. 19.

As long as the voltage is supplied to the power failure detection circuit 134 from the rectifier bridge 133, a "1" signal will be supplied to the first input of the NAND gate 149, and the oscillating signal from the oscillator circuit 151 will be supplied to the frequency divider circuit 152 and the master signal generating circuit 153. However, when there is a failure of the a.c. power supply, when the timing pulse $\overline{T2}$ is applied to the inverter 147, an "0" signal will be supplied to the first input of the NAND gate 149, thereby blocking the oscillating signal of the oscillating circuit 151 from passing therethrough. Since the duration of the timing pulse $\overline{T2}$ is determined by the oscillating signal, passage of this oscillating signal will be blocked by the NAND gate 149 until restoration of the a.c. power supply.

The oscillator circuit 151 can be of any conventional design, such as the illustrated ring oscillator circuit which produces a square wave output signal at a frequency depending on the values of the capacitor 127 and resistor 126 included in the circuit.

The frequency dividing circuit 152 consists of two successive four binary step counting circuits 154 and 156, e.g. Texas Instruments type No. 7493, connected with standard logic circuit devices of the pulse timing circuit 148, which include six inverters 157, four three-input NAND gates 158, and a seven-input NAND gate 159, thus generating four sequential timing pulses $\overline{T1}$, $\overline{T2}$, $\overline{T3}$, and $\overline{T4}$.

In all of these circuits disclosed with reference to FIGS. 18–22, most of the inverters, and the two- or three- input NAND gates are independent portions of a standard integrated circuit. For example, the type 7404 hex inverter circuit includes six inverters which may be operated independently, or the type 7410 circuit includes three three-input NAND gates which can be independently operated. Also, for convenience, two- or three-input NAND gates may be operated as an inverter by connecting the inputs.

Figure 19:
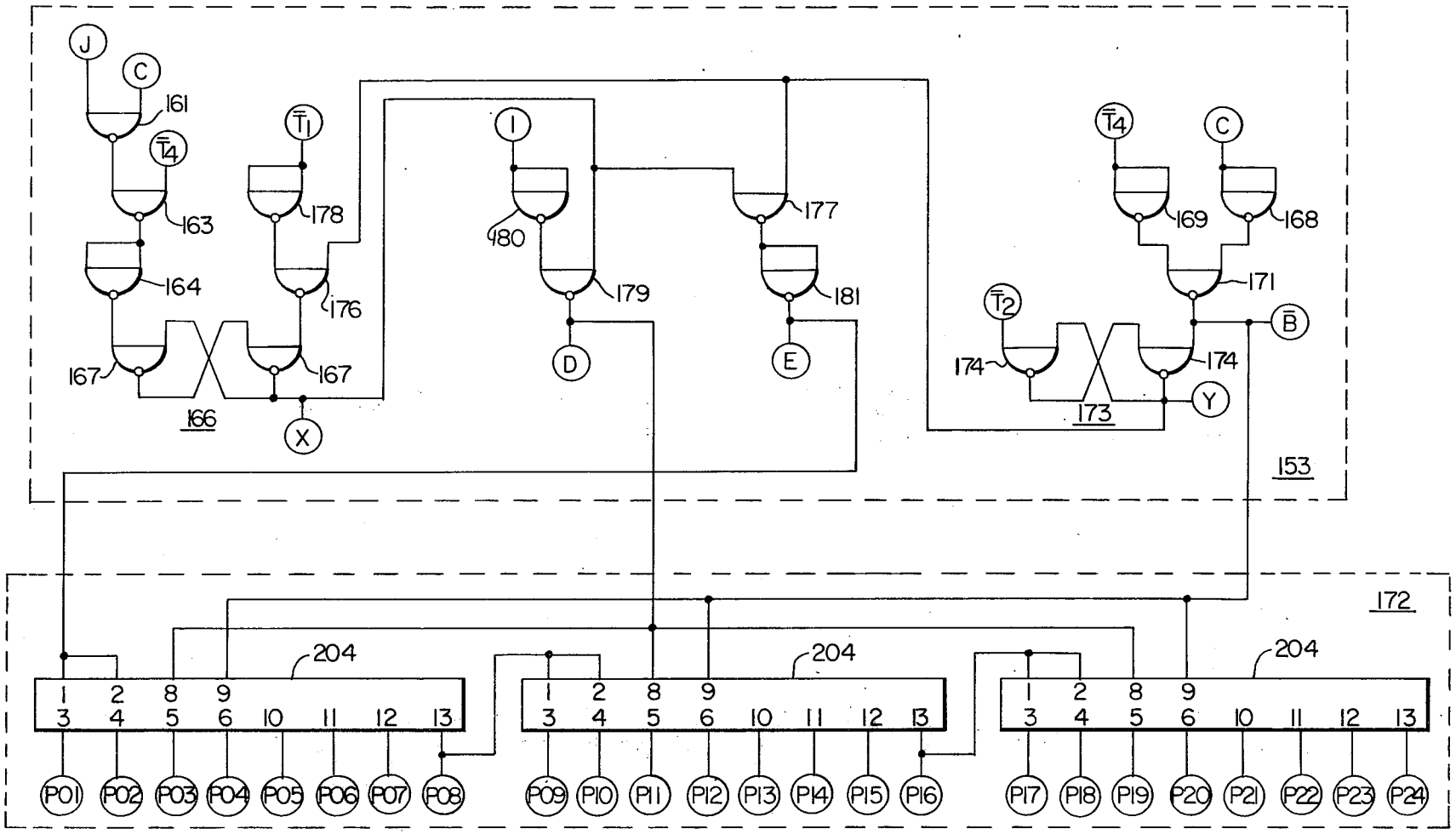
FIG. 19 is a schematic circuit diagram illustrating one embodiment of electronic circuits for accomplishing the functions of master signal generation and shift registrating according to the invention.
Figure 20:
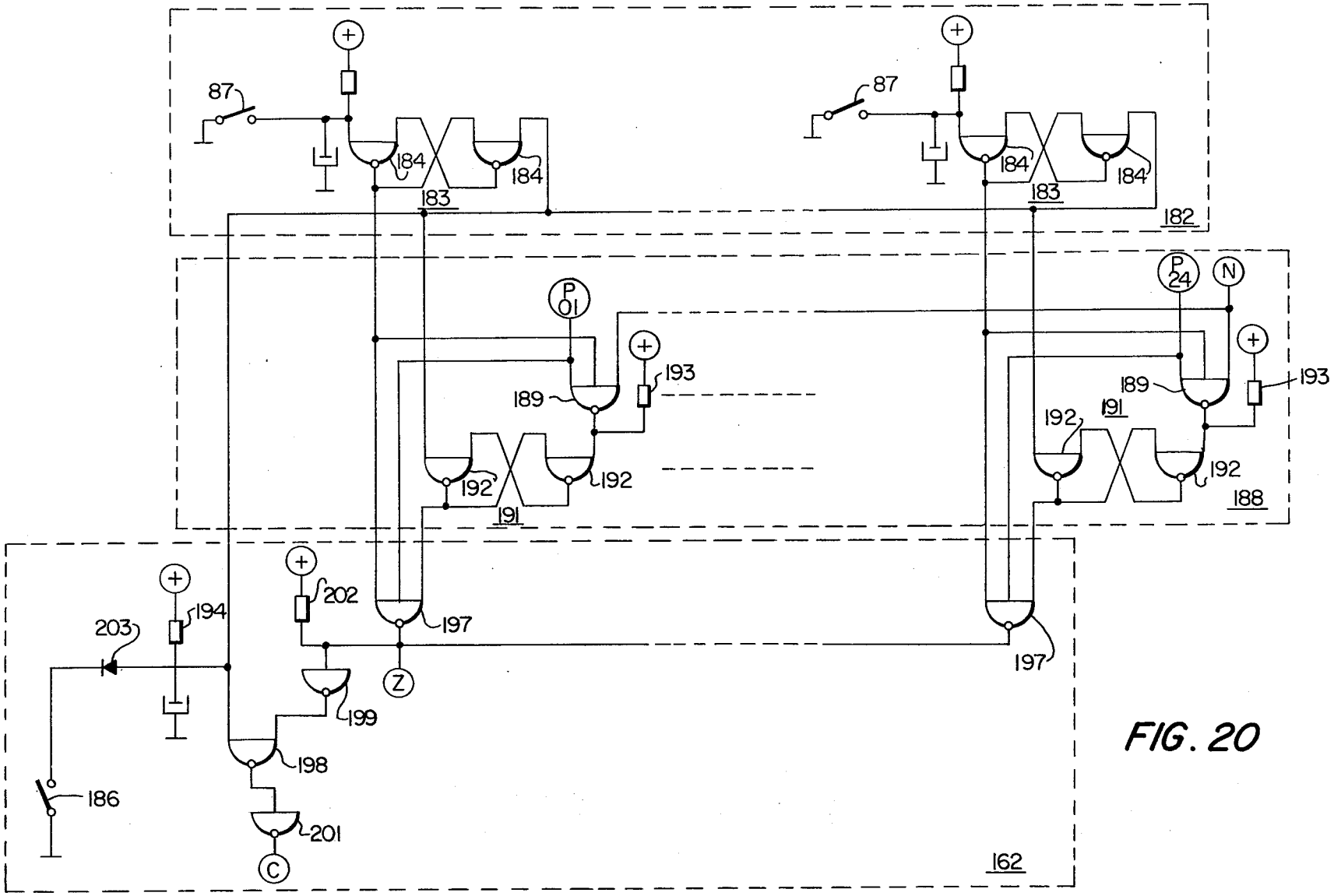
FIG. 20 is a schematic circuit diagram illustrating one embodiment of electronic circuits for accomplishing the functions of product extraction memory, product computation memory and counting pulse initiation according to the invention.

In the master signal generating circuit 153 shown in FIG. 19, a two-input NAND gate 161 has a first input connected to receive the oscillating signal output J of the NAND gate 149 of the power failure detecting circuit 134, and a second input connected to receive a signal C from a counting pulse initiation circuit 162, shown in FIG. 20. Signal C is normally "0" but becomes "1" to initiate the counting cycle. The output of the NAND gate 161 is connected to a first input of another two-input NAND gate 163, the second input of which is connected to receive the pulse timing signal $\overline{T4}$ from the pulse timing circuit 148. The output of the NAND gate 163 is connected through an inverter 164 to one input of a flip-flop memory 166 consisting of two interconnected NAND gates 167.

The C and $\overline{T4}$ signals are also supplied through respective inverters 168 and 169 to respective inputs of a two-input NAND gate 171, the output B of which is connected to the shift register circuit 172 to clear the same and to one input of flip-flop memory 173 consisting of two interconnected NAND gates 174. The other input of memory circuit 173 is connected to receive timing pulse $\overline{T2}$ from the pulse timing circuit 148. An output Y of the memory 173 is connected to respective inputs of two two-input NAND gates 176 and 177. The other input of the NAND gate 176 is connected through an inverter 178 to receive the timing pulse $\overline{T1}$ from the pulse timing circuit 148, and the output of the NAND gate 176 is connected to the other input of the flip-flop memory 166. The other input of the NAND gate 177 is connected to the output of the flip-flop memory 166, and to an input of a two-input NAND gate 179, the other input of which is connected through an inverter 180 to receive the oscillator signal 1 from the frequency divider 152. The output of the NAND gate 177 is inverted by an inverter 181, the output of which is connected to the shift register circuit 172. The output of the NAND gate 179 is connected to trigger the shift register circuit 172.

If the signal C from the counting pulse initiation circuit 162 at the input of the inverter 168 is "0" at the fourth time interval when the "0" timing pulse $\overline{T4}$ is received at the input of the inverter 169, then the output signal B of the NAND gate 171 becomes "0" to clear the shift registers of circuit 172 and to change the output signal Y of the flip-flop memory 173 to "1" until the next second time interval when the timing pulse $\overline{T2}$ input to the flip-flop memory 173 will change the output signal Y back to "0".

Also, if the counting pulse signal C supplied to the input of the NAND gate 161 is "0" at the fourth time interval when the "0" timing pulse $\overline{T4}$ is received at the NAND gate 163, the output signal X of the flip-flop memory 166 will become "0", until the "0" timing pulse $\overline{T1}$ is received at the inverter 178 which switches the output signal X of the flip-flop memory 166 to "1".

With both of the output signals X and Y of the flip-flop memories 166 and 173 at "1" during the fourth time interval, the output signal E of the inverter 181 will reamin "1", and will be fed into the shift register chain 172.

With the output signal X of the memory 166 at "1", the oscillator signal 1 supplied to the inverter 180 from the frequency dividing circuit 152 will be allowed to pass to the output D of the NAND gate 179, to trigger a shift of the shift register.

However, if the counting pulse singal C is "1" at the fourth time interval, it will not allow the output signal B of the NAND gate 171 to change to "0" and thus will not allow the clearing of the shift register circuit 172.

Also, when the counting pulse signal C is "1", the output signal X of the flip-flop memory 166 will remain at "0", and thus the oscillator pulses 1 are blocked at the NAND gate 179, the output signal D of NAND gate 179 will not shift the shift register, and the output signal E of the inverter 181 will reamin "0".

The product extraction memory circuit 182 shown in FIG. 20 includes a plurality, only two being shown, of flip-flop memories 183, each consisting of two interconnected NAND gates 184, for each of the product storge receptacles shown in FIG. 2, e.g. 24 such memories. The inputs of each memory 183 are connected to the supply from voltage regulating device 142 of the power supply circuit 131. When the bar or assembly shown in FIG. 2 is restocked, a switch 186 in the counting pulse initiation circuit 162 is closed to connect a respective one of the inputs of each memory 183 to ground, and placing an "0" signal on the outputs of all of the memories 183. The other respective input of each memory 183 is connected to ground through a respective normally open reed-switch 187, discussed above with regard to FIG. 10*d*, so that when a product is extracted and the corresponding swing bar 80 and attached magnet 82 are moved, the corresponding reed-switch 187 is closed to put a "1" signal on the output of the memory 183 for that particular product receptacle.

The product computation memory circuit 188, also shown in FIG. 20, includes for each product storage receptacle a three-input NAND gate 189 and a flip-flop memory 191 consisting of two interconnected NAND gates 192. Both inputs of each memory 191 are connected through respective limiting resistors 193 and a resistor 194 to the supply from voltage regulating device 142 of the power supply circuit 131. One input of each memory 191 can be connected to ground through the normally open switch 186, and the other input of each memory 191 is connected to the output of the respective three-input NAND gate 189. A first input of each NAND gate 189 is connected to the output of the corresponding memory 183 of the product extraction memory circuit 182. A second input of each NAND gate 189 is connected to receive a corresponding P signal, e.g. P01, from the shift register circuit 172. A third input of each NAND gate 189 is connected to receive a signal N from the counting pulse end circuit 196 shown in FIG. 21. When the bar or assembly is restocked, the switch 186 closes and changes all memories 191, such that a "1" signal appears at the outputs of all of the memories 191. When the signal N from the counting pulse end circuit 196 becomes "1", the NAND gates 189 which have their P input signals at "1" and which also have the input signal from the outputs of the corresponding memories 183 at "1", will have an "0" signal at their output, thus switching the output of the corresponding memory 191 to "0".

The counting pulse initiation circuit 162 includes a three-input NAND gate 197 for each product storage receptacle circuit. Only the circuit for the first storage receptacle 01 is shown. The three inputs of the NAND gate 197 for each receptacle, e.g. for the first receptacle 01, are connected respectively to the output of the corresponding memory 183 of the product extraction memory circuit 182, to the output of the corresponding memory 191 of the product computation memory circuit 188, and to the corresponding P01 signal from the shift register. The output of the three-input NAND gate 197 is connected through the limiting resistor 202 to the supply from the voltage regulating device 142 of the power supply circuit 131 and through an inverter 199 to an input of a two-input NAND gate 198. The second input of the NAND gate 198 is connected through the limiting resistor 194 to the voltage regulating device 142, and through a diode 203 to ground through the normally open switch 186. The output of the two-input NAND gate 198 is inverted by an inverter 201 to produce the counting pulse signal C.

When a product is extracted for the first receptacle, e.g. receptacle 01, the output signal of the corresponding memory 183 will become "1", and if it has not been counted already, the output signal of the corresponding memory 191 will be at "1". Thus, when the signal P01 becomes "1", the output signal Z of the three-input NAND gate 197 becomes "0", and therefore the C signal becomes "1", to thereby initiate a counting operation. The moment when the counting operation is completed, the output signal of the memory 191 becomes "0", the output signal Z of the NAND gate 197 returns to "1", and the output signal C of the inverter 201 returns to "0", and so the cycle is completed.

The shift register circuit 172, shown in FIG. 19, includes three 8-bit, parallel out, serial shift right registers 204, which may, e.g. be Texas Instruments type 74164 registers. The registers 204 are cleared with the signal B from the master signal generating circuit 153. THe signal E from the same circuit 153 causes a "1" to be placed in the first step and entered at the P01 position with the first clock provided by the signal D from the master signal generating circuit 153. Once this is achieved, the signal E from the master signal generating circuit 153 changes to "0", and the "1" of P01 shifts along all the P signals successively, as clock pulses are received.

Figure 21:
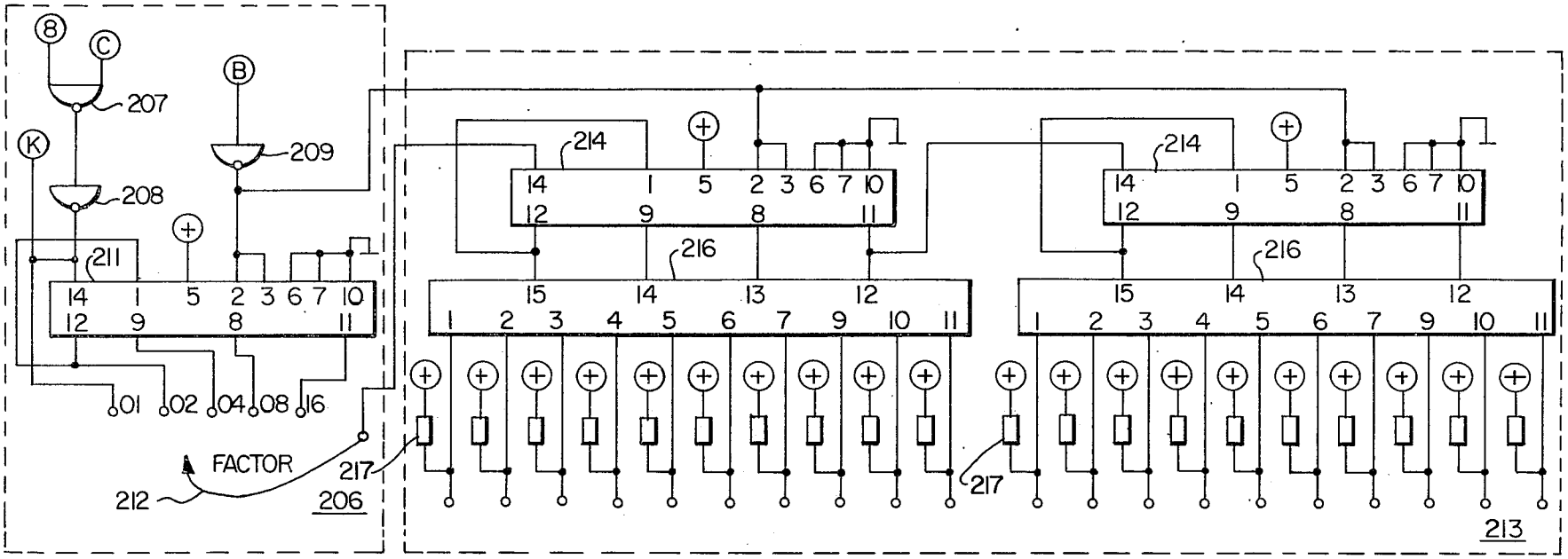
FIG. 21 is a schematic circuit diagram illustrating one embodiment of electronic circuits for accomplishing the functions of common multiplier programming and pulse counter registering according to the invention.
Figure 22:
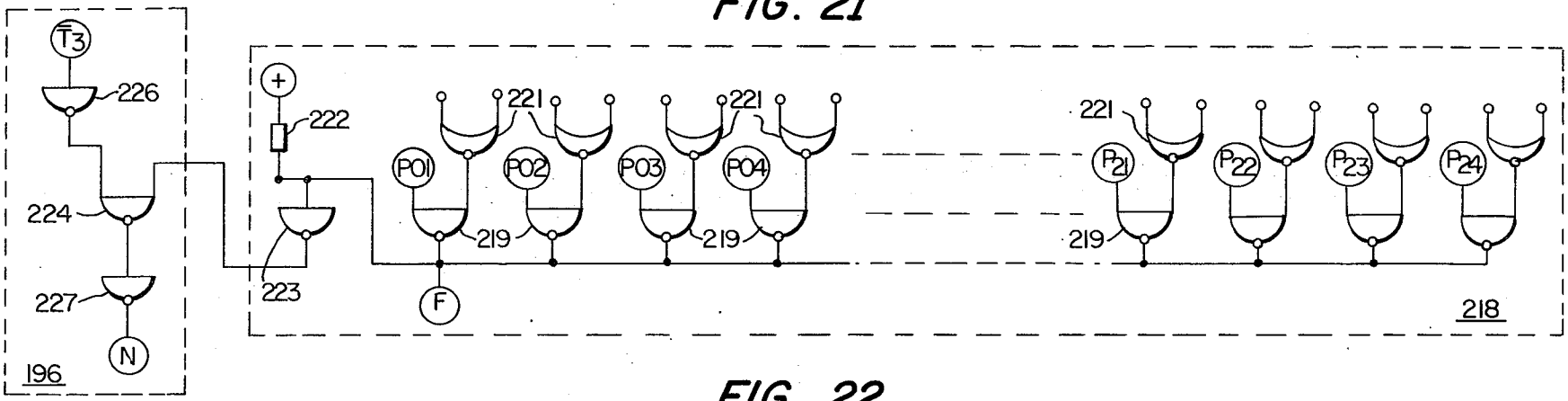
FIG. 22 is a schematic circuit diagram illustrating one embodiment of electronic circuits for accomplishing functions of specific programming and counting pulse ending according to the invention.

The common multiplier program circuit 206 shown in FIG. 21 includes a two-input NAND gate 207, two inverters 208 and 209 and a counter 211, e.g. a Texas Instruments type 7493, base 16, non-presettable, ripple counter. One input of the two-input NAND gate 207 is connected to receive the signal C from the counting pulse initiation circuit 162, the other input of the two-input NAND gate 207 is connected to receive pulse counts from the counter 156 of the frequency divider circuit 152, and the output of the NAND gate 207 is connected through the inverter 208 to an input of the counter 211. When the signal C becomes "1", the pulse signal from the counter 156 will be fed into the frequency dividing circuit 211, and by means such as a flexible wire factor connection or multiplier 212, an appropriate frequency division may be selected from 1, 2, 4, 8 or 16 and fed to the pulse counter register circuit 213. When the signal B from the master signal generating circuit 153, which is supplied to the counter 211 through inverter 209, becomes "0", then the counter 211 is cleared.

The pulse counter register circuit 213 includes two decade counters 214, e.g. Texas Instruments type 7490 decade counters, two decoders 216, e.g. Texas Instruments type 74141 decoders, and twenty resistors 217. The selected pulses from the counter 211 of the common multiplier program circuit 206 are computed by the two decade counters 214 connected in series, and decoded by the two decoders 216 to the decimal system. When the signal B supplied to the counters 214 through the inverter 209 becomes "0", the counters 214 are cleared.

The specific programmer circuit 218 includes a plurality corresponding to the number of product receptacles, e.g. 24, of two-input NAND gates 219, each having one input connected to receive a respective one of the signals P01, P02 . . . P24, from the shift register circuit 172, and another input connected to the output of a respective NOR gate 221. The outputs F of all of the NAND gates 219 are connected in common to the voltage regulating device 142 through a limiting resistor 222 and through an inverter 223 to one input of a two-input NAND gate 224 in the counting pulse end circuit 196. A given product has a flexible wire connection for units and decades programming so that representative value figures from 0 to 99 can be programmed. When the number of computer pulses from the decade counters 214 decoded by the decoders 216 fits the programmed value figure for a particular product the P signal of which is at "1", the signal F becomes "0", and therefore there will be a "1" signal at the output of the inverter 223.

The counting pulse end circuit 196 includes the two-input NAND gate 224, having one input connected to the output of the inverter 223, a second input connected through an inverter 226 to receive the $\overline{T3}$ timing pulse from the pulse timing circuit 148 during the third time interval, and an output connected through an inverting circuit 227 to produce the signal N. When the signal F becomes "1" at the third time interval, the signal N becomes "1" and thus allows a change in the corresponding "counting completed" memory 191 in the product computation memory circuit 188.

The output amplifier and electromagnetic counter circuit 137 includes an amplifier circuit 228, e.g. a Texas Instruments type 75450 amplifier circuit, connected to amplify the pulses received from the common multiplier program circuit 206 to obtain a desired output level, e.g. a 24 v.d.c. 300 mA output level, which is transmitted to an electromagnetic counter 229, which is located at a desired position, such as the front desk.

The operation of the above described logic circuits is as follows. When a product is extracted, for example from the first receptacle 01, the reed-switch 187 for this first receptacle 01 will close. This will introduce an "0" signal into one input of the respective RS flip-flop memory 183 of the product extraction memory circuit 182 and change the output of this memory 183 to a "1" signal, which will open the corresponding three-input NAND gate 197 of the counting pulse initiation circuit 162 when the second input to this NAND gate 197 from the output of the RS flip-flop memory 191 of the product computation memory circuit 188 is "1", which it will be since it has not as yet been counted, and when the P01 signal is "1", which it will be when the shift register reaches this position. When this occurs, the output signal Z of the three-input NAND gate 197 will be "0", whereby the signal C will become "1", thus initiating the counting cycle.

With the signal C at "1", the NAND gate 207 of the common multiplier program circuit 206 will open, whereby the oscillator pulses 8 from the frequency divider circuit 152 are fed to the counter 211 of the common multiplier program circuit 206, as well as to an amplifier circuit 228 of the output amplifier circuit 137, the output pulses of which are transmitted to an electromagnetic counter 229 at a centralized control site, such as at the office desk.

In the counter 211 there is produced a frequency division so that, by programming the common factor, the pulses to be computed by the counters 214 of the pulse counter register circuit 213 are chosen, and the electromagnetic counter 229 will in this way count 1, 2, 4 . . . times more than the counters 214.

The amount counted by the counters 214 of the pulse count register circuit 213 is codified to the decimal system by the decoder circuits 216, and in this way the specific factor will be programmed in the decimal system.

The particular NAND gate 219 of the specific programmer circuit 218 corresponding to the product receptacle 01 is prepared by the P01 signal at "1" and at such condition awaits the equal reference value which has previously been programmed at the two inputs of the corresponding NOR gate 221 to be produced. When this takes place, the signal F will become "0", and in the third time interval the signal N will become "1". Since the P01 signal is "1", and the output signal of the corresponding memory 183 of the product extraction memory circuits 183 is "1", when the signal N becomes "1", the corresponding three-input NAND gate 189 of the product computation memory circuit 188 will have an "0" output signal. Consequently, the output signal Z of the three-input NAND gate 197 in the counting pulse initiation circuit 162 will become "1", and the signal C will become "0", thus ending the counting cycle and initiating the exploration cycle. It should be noted that with the signal C at "0", the NAND gate 207 in common multiplier program circuit 206 remains blocked, and consequently there will be no pulses for the electromagnetic counter 229 or for the counters 211 and 214 of the common multiplier program circuit 206 and the pulse counter register circuit 213, respectively.

When there is no product to be counted, all of the memories 183 of the product extraction memory circuit 182 are constantly exploring, one after the other, by means of the corresponding signals P01, P02 . . . P24 coming from the shift register circuit 172. If this exploration is fruitless, it will continue in the exploration cycle until an output signal of a memory 183 is detected at "1", and with the output of the corresponding memory 191 still at "1", since it has not yet been found, at which moment the signal Z will change to "0", thus again beginning the counting cycle.

All of the components or circuits of the general logic circuit are energized from the positive voltage supplied through voltage regulating device 142 from the power supply circuit 131. When a power failure occurs, the output of the oscillator circuit 151 is blocked by the power failure detection circuit 134, and the system remains stationary at the condition or point at which it is then located, i.e. the voltage cycle or the exploration cycle, and continues memorizing. Thus, in spite of there not being any pulses or oscillations, any extraction occurring during the power failure will be memorized in the respective memory 183 of the product extraction memory circuit 182. When the power is restored, the output of the oscillator circuit 151 is unblocked at the NAND gate 149 of the power failure detection circuit 134, and the system continues from the point at which it stopped.

It will be apparent from the above description that the movement of a door or swing bar 80 of a particular receptacle, to remove the product contained therein, will actuate a particular corresponding reed-switch 187. This will result in the production of a signal which is weighted to represent a value assigned to the particular product. All such weighted value means will be accumulated as a record of consumption of total products removed from various receptacles of the assembly.

The basic variables of the apparatus of the invention are:

For the cooling system
(a) without cooling.
(b) with cooling by means of the Peltier effect.
(c) with cooling by means of a compressor.
(d) with cooling by absorption.

For the registering system
(a) electromagnetic meter at a centralized site.
(b) electromagnetic meter in the apparatus itself.
(c) electromagnetic meter at both sites.
(d) digital meter at a centralized site.
(e) digital meter in the apparatus itself.
(f) digital meter at both sites.
(g) electronic ordinator.

For the number of receptacles
Any number of rows with any number of receptacles per row. Furthermore, all the receptacles can be chilled, or none at all need be chilled, or some may be chilled and others not.

For the cabinet
Any type of cabinet having any shape, dimensions, color, construction, or material.

It will further be apparent that various other modifications may be made to the above specifically described structural and electronic arrangements without departing from the scope of the invention.

What is claimed is:

1. A device for dispensing products such as foodstuffs in locations such as hotel rooms, said device comprising:

a receptacle assembly having therein a plurality of receptacles arranged in a plurality of rows and a plurality of columns, each of said receptacles adapted to contain therein a product, said receptacle assembly being modular and comprising:

two symmetrical opposite lateral end elements spaced and positioned parallel to each other, each said end element having thereon inwardly facing slide elements;

a plurality of intermediate partition elements arranged parallel to each other and parallel to said end elements, each said partition element having thereon oppositely facing slide elements;

said end elements and partition elements being laterally spaced to provide a desired said plurality of columns, a plurality of groups of shelves positioned between each pair of adjacent partition elements and between each end element and adjacent partition element, each said shelf fitting on said slide elements, the shelves of each group being spaced, and the spacing between shelves of each of said plurality of groups being the same, thus providing a desired said plurality of rows; and said end elements, partition elements and shelves defining therebetween said plurality of receptacles, each said receptacle having a product withdrawal opening;

means for cooling at least a portion of said rows of receptacles;

each said receptacle having a swingable door pivotably connected thereto to pivot from a first position blocking the respective opening thereof to a second position unblocking said opening thereof and whereat a product contained in said receptacle may be withdrawn;

electrical detection means associated with each of said doors for detecting movement thereof from said first position to said second position and for producing an electric signal representative of such movement, said detection means of each said receptacle being codified to produce an electric signal weighted to represent the value of the product in said each receptacle; and electronic circuit means, operatively connected to all of said detection means, for receiving said signals from said detection means and for accumulating said signals as a record of consumption of products from said assembly.

2. A device as claimed in claim 1, further comprising grooves in each said end element and partition element; a plurality of dividing strips each having projections fitted into said grooves, there being one dividing strip extending across each of said rows; said doors of each said row being pivotally mounted on one of said dividing strips.

3. A device as claimed in claim 2, wherein said detection means are mounted on said respective dividing strips.

4. A device as claimed in claim 1, wherein said doors are formed of transparent material.

5. A device as claimed in claim 1, further comprising means for urging each of said doors into said first position thereof.

6. A device as claimed in claim 1, wherein each said detection means comprises a magnet on the respective said door; and switch means positioned on the respective said receptacle for detecting movement of said magnet.

* * * * *